US008573443B2

(12) United States Patent
Natterer

(10) Patent No.: US 8,573,443 B2
(45) Date of Patent: Nov. 5, 2013

(54) TOUCH FREE MULTI-PRODUCT DISPENSER

(76) Inventor: Mark R. Natterer, Lebanon, OR (US)

( * ) Notice: Subject to any disclaimer, the term of this patent is extended or adjusted under 35 U.S.C. 154(b) by 269 days.

(21) Appl. No.: 12/932,754

(22) Filed: Mar. 5, 2011

(65) Prior Publication Data

US 2012/0223098 A1 Sep. 6, 2012

(51) Int. Cl.
*B67D 1/00* (2006.01)

(52) U.S. Cl.
USPC ..... 222/52; 222/63; 222/173; 222/174; 222/325; 222/333

(58) Field of Classification Search
USPC ..... 222/49, 52, 61, 23, 43, 55, 63, 162, 222/163, 171, 173, 333, 182, 321.8, 325, 222/321.7, 174, 31, 309, 41, 612
See application file for complete search history.

(56) References Cited

U.S. PATENT DOCUMENTS

| | | | | | |
|---|---|---|---|---|---|
| 916,998 | A * | 4/1909 | Chambers | 222/174 |
| 2,967,643 | A * | 1/1961 | Edelstein et al. | 222/647 |
| 3,032,081 | A * | 5/1962 | La Cotta | 141/362 |
| 4,184,612 | A * | 1/1980 | Freyre | 222/639 |
| 4,625,342 | A * | 12/1986 | Gangnath et al. | 4/228.1 |
| 4,722,372 | A * | 2/1988 | Hoffman et al. | 141/98 |
| 5,255,822 | A * | 10/1993 | Mease et al. | 222/63 |
| 5,829,642 | A * | 11/1998 | Momboisse | 222/162 |
| 5,853,166 | A * | 12/1998 | Koza | 256/59 |
| 5,988,440 | A * | 11/1999 | Saunders et al. | 222/63 |
| 6,318,600 | B1 * | 11/2001 | Winnett et al. | 222/173 |
| 6,467,651 | B1 | 10/2002 | Muderlak et al. | |
| 6,722,529 | B2 * | 4/2004 | Ceppaluni et al. | 222/63 |
| 6,820,770 | B2 * | 11/2004 | Makino et al. | 222/180 |
| 7,766,194 | B2 | 8/2010 | Boll et al. | |
| 7,785,541 | B1 * | 8/2010 | Fiorello | 422/124 |
| 7,909,209 | B2 * | 3/2011 | Reynolds et al. | 222/41 |
| 8,342,369 | B2 * | 1/2013 | Hsu | 222/309 |
| 2003/0160073 | A1 * | 8/2003 | Gispert Casino et al. | 222/386 |
| 2004/0149779 | A1 * | 8/2004 | Boll et al. | 222/333 |
| 2006/0096349 | A1 * | 5/2006 | Czernecki et al. | 73/1.74 |
| 2007/0000941 | A1 * | 1/2007 | Hadden et al. | 222/52 |
| 2008/0011782 | A1 * | 1/2008 | Sidman | 222/192 |
| 2008/0056691 | A1 * | 3/2008 | Wingo et al. | 392/395 |
| 2009/0261124 | A1 * | 10/2009 | Boll et al. | 222/180 |

* cited by examiner

*Primary Examiner* — Frederick C Nicolas
*Assistant Examiner* — Bob Zadeh
(74) *Attorney, Agent, or Firm* — Teri G. Andrews; Patent Attorney

(57) ABSTRACT

The present invention is a universal touch free dispenser for dispensing selective amounts of product from varying sized hand pump product containers. There is a touch free sensor on the front of the dispenser and in electrical communication with the drive assembly of the dispenser. An extendable ram pad extends from the drive assembly that is adjustable according to the amount of product a user wishes to be dispensed. With the product container placed within the dispenser, the unit is adjusted such that the pump on the container is in contact with the dispenser ram. When an object is placed within the viewing range of the touch free sensor, a signal is sent to the drive assembly and the dispenser ram is extended thereby depressing the pump head and dispensing the product onto the object.

20 Claims, 8 Drawing Sheets

TOUCH FREE MULTI-PRODUCT DISPENSER

FIELD OF THE INVENTION

The present invention relates, in general, to devices for dispensing viscous fluids, and, more particularly, to a touch free adjustable dispenser for dispensing a variety of products from containers of varying sizes.

BACKGROUND OF THE INVENTION

Touch free dispensers have become common for hand soap, dish soap, hand lotion and the like and are individually designed for only one such fluid. Typically, these touch free dispensers have a motion sensor that detects the presence of a hand and then dispenses a set amount of soap or lotion. One variation of this type of dispenser has a container which is refillable with a liquid designated for use in that particular dispenser whether soap or lotion. Even if the dispenser is capable of dispensing either soap or lotion, one can imagine it would be imperative to remove all soap from the dispensing nozzle prior to filling with lotion and vice versa. This can be extremely messy, wasteful, and time consuming.

Another variation of a touch free dispenser currently on the market has replaceable containers that are simply disconnected from the main dispenser and thrown away when empty. Unfortunately, this requires the user to purchase only the product that fits the size and dispensing capabilities of the original dispensing unit, otherwise the unit will likely plug, over dispense, or drool. Even if the dispenser is capable of dispensing soap or lotion, it also becomes a cleaning issue with regard to the dispensing nozzle to alternate between soap, lotion, or other such household fluids. The containers also do not allow the user to easily dispense the remaining contents within the container if the dispenser fails and is no longer operational.

One liquid soap dispenser is disclosed in U.S. Pat. No. 6,467,651 issued to Muderlak et al which discloses an automatic liquid soap dispenser that has a housing adapted to removably receive and hold a fluid soap container. In Muderlak, the soap dispenser dispenses a measured amount of soap each time. The Muderlak dispenser is designed to be above the sink while the container is attached below the sink, which requires a hole to be cut within the sink surface or the countertop. The main issues with the Muderlak design are that it is designed specifically for liquid hand soap, has one set dispense quantity, and is not adaptable to accommodate other types of fluids such as lotions, shampoo, conditioners, or condiments such as ketchup, mayonnaise, mustard, cosmetics and the like. Furthermore, it is a design that is fixed to the countertop or sink lacking portability.

U.S. Pat. No. 7,766,194 issued to Boll et al discloses a touch free household liquid dispenser that in one embodiment utilizes a conventional retail hand soap pump bottle. Although Boll eliminates the need to use a specific type of household liquid, i.e. hand soap, dish soap, lotion, etc., it does require a specific shape and height of pump bottle to function properly within the housing of the dispenser. In touch free mode, the Boll dispenser continues to dispense as long as a hand or object is present before the sensor which can create waste.

There is a need for a household or commercial use liquid dispenser that is touch free, is adjustable to accommodate almost any size or shape of pump bottle, has the ability to readily adjust the quantity of liquid to be dispensed, does not require cleaning of a dispensing nozzle, and can switch between dispensing hand soap, dish soap, lotion, shampoos, suntan lotion, condiments (such as ketchup, mayonnaise, mustard), cosmetics, medicines, or any viscous material within a container that has its own built-in pump that is actuated by a downward motion. There is also a need for a liquid dispenser that allows the user to have the most flexibility possible, such as when the container is removed from the touch free dispenser product can still be pumped out of the container by hand.

SUMMARY OF THE INVENTION

It is the object of the present invention to provide a touch free dispenser for dispensing a variety of household and commercial products such as hand soap, dish soap, lotion, shampoo, suntan lotion, condiments (such as ketchup, mayonnaise, mustard), cosmetics, medicines, or any viscous material within a container that has its own built in pump that is actuated by a downward motion. Switching between the aforementioned liquids should require minimal or no adjustment by the user.

It is another object of the present invention to provide a touch free dispenser that is easily adjustable in height to accommodate almost any size of currently available hand pumped products thereby allowing the user to select from small containers to value-sized containers with minimal effort and adjustment of the touch free dispenser by the user.

It is yet another object of the present invention to provide a touch free dispenser that utilizes the nozzle and pumping mechanism of a purchased product container eliminating the mess associated with refilling the container and cleaning the dispensing nozzle.

The present invention is a universal touch free dispenser for dispensing selective amounts of product from varying sized hand pump product containers. There is a touch free sensor on the front of the dispenser and in electrical communication with the drive assembly of the dispenser. An extendable ram pad extends from the drive assembly that is adjustable according to the amount of product a user wishes to be dispensed. With the product container placed within the dispenser, the unit is adjusted such that the pump on the container is positioned under the ram. When an object is placed within the viewing range of the touch free sensor, a signal is sent to the drive assembly and the ram pad is extended thereby depressing the pump head and dispensing the product onto the object.

BRIEF DESCRIPTION OF THE DRAWINGS

The above description and other objects, advantages, and features of the present invention will be more fully understood and appreciated by reference to the specification and accompanying drawings, wherein.

DRAWING ELEMENT NUMBERS

| | |
|---|---|
| 100 | Touch Free Dispenser |
| 102 | Dispenser Head Assembly |
| 104 | Low Battery Indicator |
| 106 | Throw Adjustment Knob |
| 108 | On/Off Switch |
| 110 | Unit Height Slide Rail |
| 112 | Unit Height Adjustment Knob |
| 114 | AC Adapter Plug |
| 116 | Dispenser Base |
| 117 | Hollow Lower Vertical Member |
| 118 | Base Top Surface |
| 120 | Base Feet |
| 122 | Ram Guide |
| 124 | Head Assembly Top Surface |
| 126 | Base Non Slip Pad |
| 202 | Touch Free Sensor |
| 402 | Product Container |
| 404 | Pump Head |
| 406 | Dispenser Ram |
| 407 | Ram Pad |
| 502 | Alternate Container |
| 504 | Shroud |
| 600 | Drive Motor |
| 602 | Batteries |
| 604 | Control Board |
| 606 | Ram Height Adjustment Sensor |
| 608 | Ram Drive Gear |
| 610 | Bearing |
| 612 | Motor Drive Gear |
| 614 | Ram Up Switch |
| 616 | Drive Assembly |
| 618 | Throw Adjustment Lead Screw |
| 620 | Sensor Mount |
| 702 | Valve Solenoid |
| 704 | Adjustment Dispenser Stop |
| 706 | Vertical Member |
| 716 | Alternate Drive Assembly |
| 718 | Dispenser Height Stop |
| 720 | Top Solenoid Shaft |

DETAILED DISCUSSION OF THE PREFERRED EMBODIMENTS

Referring to the figures, like elements retain their indicators throughout the several views.

Figure 1:
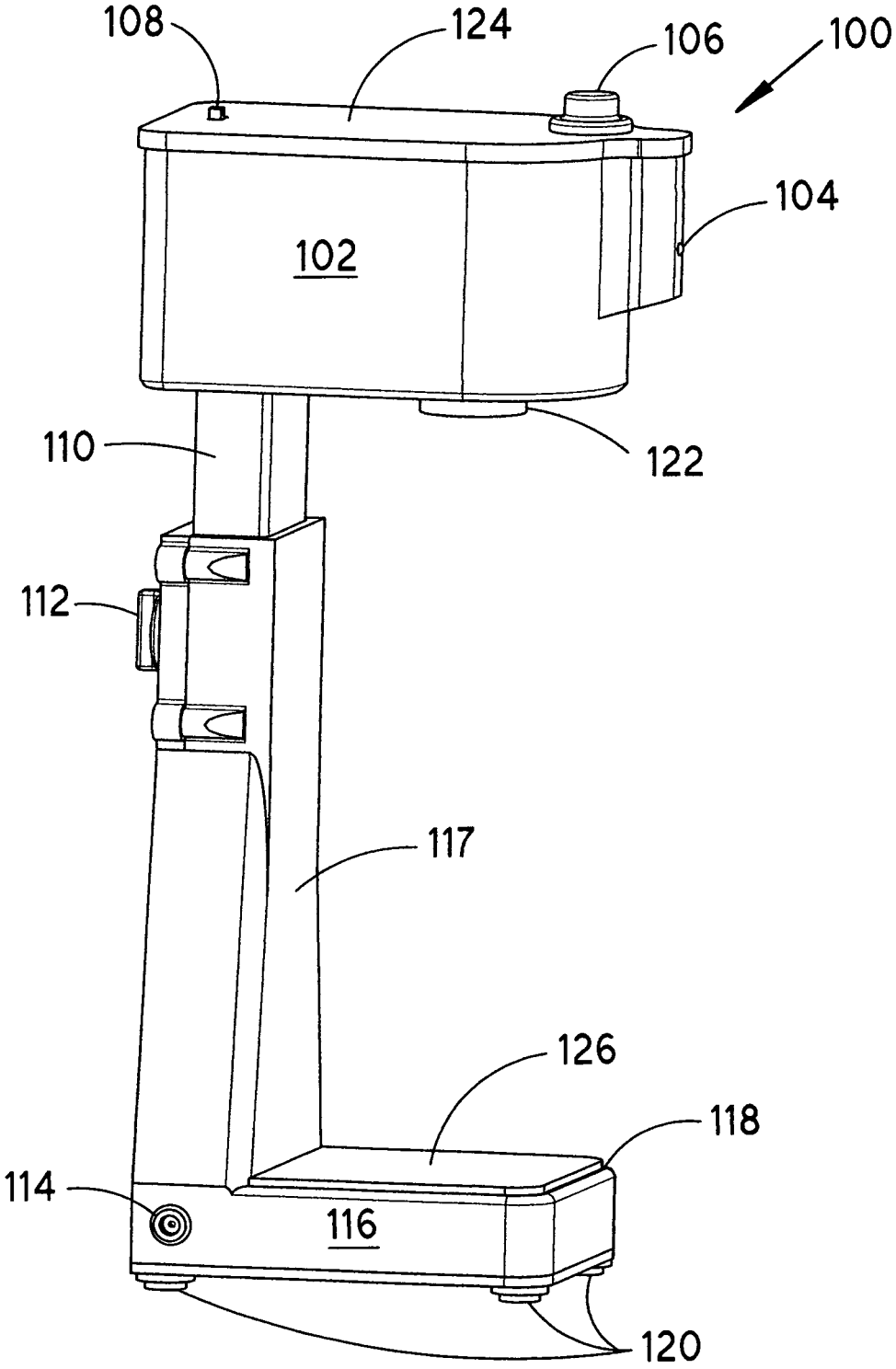
FIG. 1 is a perspective view of the touch free dispenser of the present invention.

FIG. 1 is a perspective view of Touch Free Dispenser 100 of the present invention. Dispenser Head Assembly 102 has an On/Off Switch 108 located on Head Assembly Top Surface 124 for turning the Touch Free Dispenser 100 on and off. Throw Adjustment Knob 106 is also located on Head Assembly Top Surface 124 which allows the user to adjust the amount of the product to be dispensed. Low Battery Indicator 104 is located on the front of Dispenser Head Assembly 102 to alert the user to change the batteries in the event Touch Free Dispenser 100 is operating on batteries. In the preferred embodiment, Low Battery Indicator 104 is a red LED, however, it can be any color or type of lighting devise that is visible to the user.

Ram Guide 122 extends from the bottom surface of Dispenser Head Assembly 102 and guides Dispenser Ram 406 (not shown) downward to contact the pump head of a product container (not shown). Dispenser Head Assembly 102 is slideably attached to Lower Vertical Member 117 by Unit Height Slide Rail 110 that is fixedly attached to and extending perpendicularly downward from the base of Dispenser Head Assembly 102 and slides within and parallel to Lower Vertical Member 117. Lower Vertical Member 117 extends upward and perpendicularly from Base Top Surface 118 of Dispenser Base 116. Base Non Slip Pad 126 is affixed to Base Top Surface 118. Base Non Slip Pad 126 can be a type of elastomeric material such as polyurethane, neoprene, rubber or the like. Although Base Non Slip Pad 126 is an option, it helps to stabilize the product container on Base Top Surface 126 minimizing slippage when in use.

In FIG. 1, Unit Height Adjustment Knob 112 is screwably attached to Lower Vertical Member 117 with an end (not shown) extending through Lower Vertical Member 117 and contacting Unit Height Slide Rail 110 when turned clockwise thereby fixing the height of Touch Free Dispenser 100. For example, with a product container placed on Base Non Slip Pad 126, Unit Height Adjustment Knob 112 is turned counterclockwise releasing Unit Height Slide Rail 110 to slide freely within Dispenser Lower Vertical Member 117 such that Ram Guide 122 touches the pump head of a chosen product container. When satisfactorily in place, Unit Height Adjustment Knob 112 is turned clockwise thereby engaging the end of Unit Height Adjustment Knob 112 against Unit Height Slide Rail 110 holding the product container in place as well as setting the height of Touch Free Dispenser 100. It has been contemplated that Unit Height Adjustment Knob 112 can include an extendable screw, a cam system, or a ratcheting system that firmly affixes to Unit Height Slide Rail 110 thereby fixing the height of Touch Free Dispenser 100.

As shown, Dispenser Base 116 has Base Feet 120 placed in the four corners of the bottom surface of Dispenser Base 116. Base Feet 120 in the preferred embodiment are a soft rubber material to avoid sliding of Touch Free Dispenser avoiding scratching or galling of the surface it is placed upon. It has also been contemplated to have one large rubber pad attached to the bottom of Dispenser Base 116 rather than four individual Base Feet 120.

In the preferred embodiment, Touch Free Dispenser 100 is operated by either AC power or DC batteries. Alternately, if rechargeable batteries are used, an AC Adapter recharges the batteries as well as powers the Touch Free Dispense 100 unit. AC Adapter Plug 114 is located along an outer side of Dispenser Base 116 for plugging into a power cord that is plugged into a standard AC wall outlet.

Figure 2:
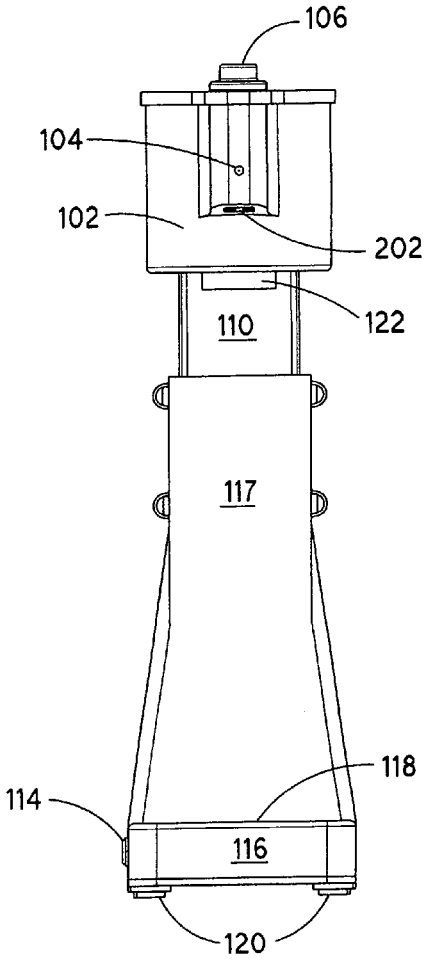
FIG. 2 is a front plan view of the touch free dispenser of the present invention.

FIG. 2 is a front plan view of Touch Free Dispenser 100 of the present invention. Touch Free Sensor 202 projects downward from Dispenser Head Assembly 102. When a users hand or object is placed within the view of Touch Free Sensor 202, the driving mechanism (shown and discussed in detail in FIGS. 6 and 7) housed within Dispenser Head Assembly 102 drives Dispenser Ram 406 (not shown) downward depressing the pump head of a product container (not shown) thereby dispensing the product into a hand or onto an object without the user having to contact Touch Free Dispenser 100. Touch Free Sensor 202 in the preferred embodiment is an infrared proximity sensor. However, any proximity sensor that will see an object such as a hand at a reasonable distance can be used.

Figure 3:
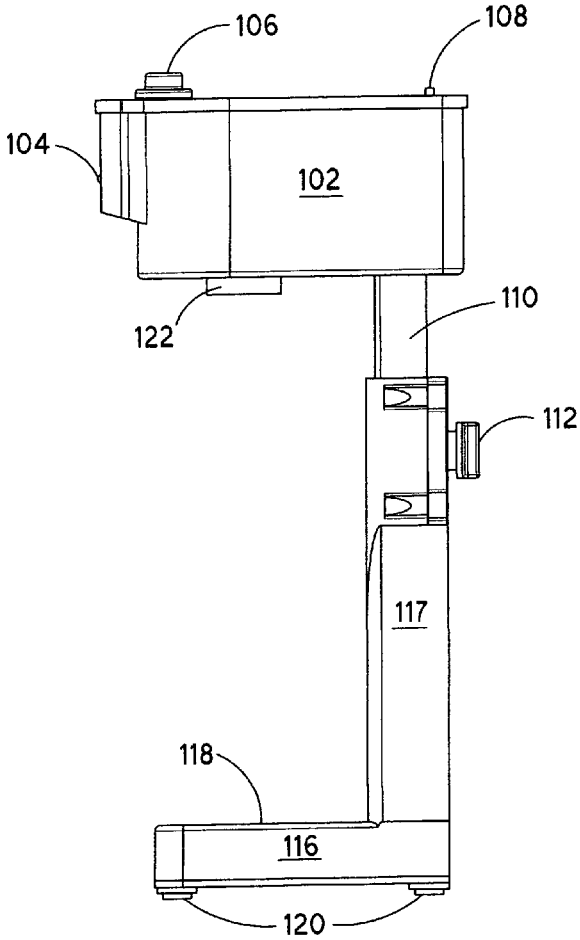
FIG. 3 is a side plan view of the touch free dispenser of the present invention.

FIG. 3 is a side plan view of Touch Free Dispenser 100 of the present invention illustrating the openness of Touch Free Dispenser 100 accommodating round, square, rectangular, large, and small containers to be placed between Ram Guide 122 and Base Top Surface 118.

Figure 4A:
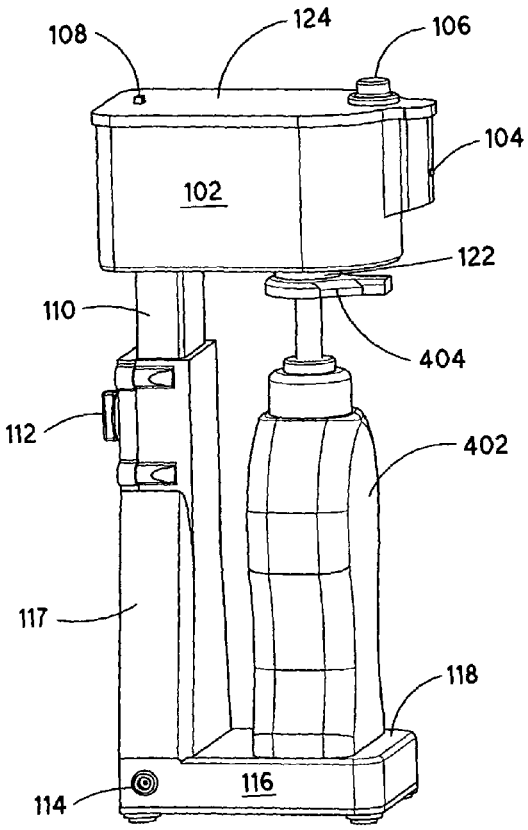
FIG. 4*a-b* is a perspective view of the touch free dispenser of the present invention with a product container in position with the pump head in the fully extended or non-dispense mode (FIG. 4*a*), and a product container in position with the pump head in the fully compressed or dispense mode (FIG. 4*b*).

FIG. 4*a* is perspective view of Touch Free Dispenser 100 of the present invention with Product Container 402 in position with Pump Head 404 in the fully extended or non-dispense mode.

To reach the optimum height of Touch Free Dispenser 100, Unit Height Adjustment Knob 112 is loosened to freely slide Dispenser Head Assembly 102 upward or downward with Product Container 402 placed on Base Top Surface 118 and Pump Head 404 positioned below Ram Guide 122. With Dispenser Head Assembly 102 contacting Pump Head 404, Unit Height Adjustment Knob 112 is tightened to eliminate any movement of Product Container 402 during use.

Figure 4B:
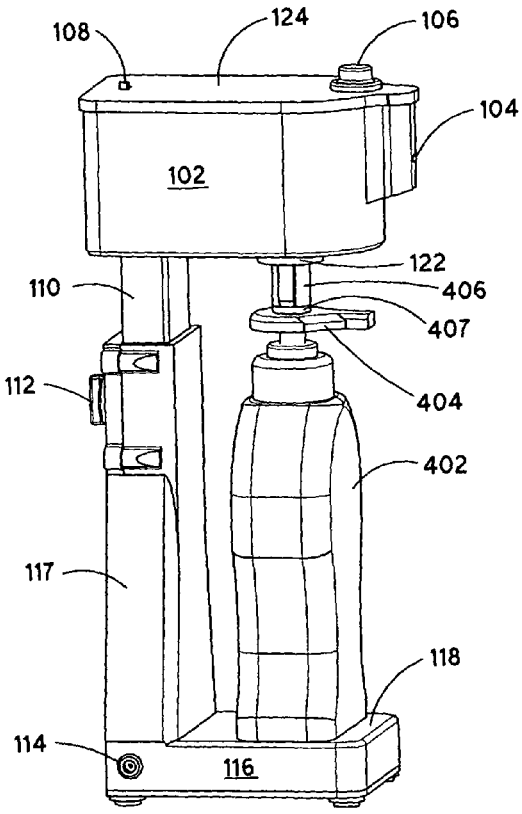

FIG. 4*b* illustrates Dispenser Ram 406 extended downward through Ram Guide 122 compressing Pump Head 404 of Product Container 402 thereby dispensing product into the user's hand or onto an object receiving an amount of the product from Product Container 402. In the preferred embodiment, Dispenser Ram 406 has a Ram Pad 407 attached to the surface that contacts Pump Head 404 minimizing slippage with a variety of Pump Head 404 configurations.

Touch Free Dispenser 100 is designed to accommodate most soap, lotion, shampoo, condiments, and other pump-dispensed products. As one can appreciate, each type of product will likely have a different amount of product desired to be dispensed. By adjusting Throw Adjustment Knob 106 (discussed in detail in FIG. 6), Dispenser Ram 406 can be controlled to extend only the distance necessary or desired by the user to dispense a particular quantity of product from Product Container 402. Ram Pad 407 in the preferred embodiment is polyurethane, however, any elastomeric pad that is abrasion, tear and impact resistant can be used.

Figure 5A:
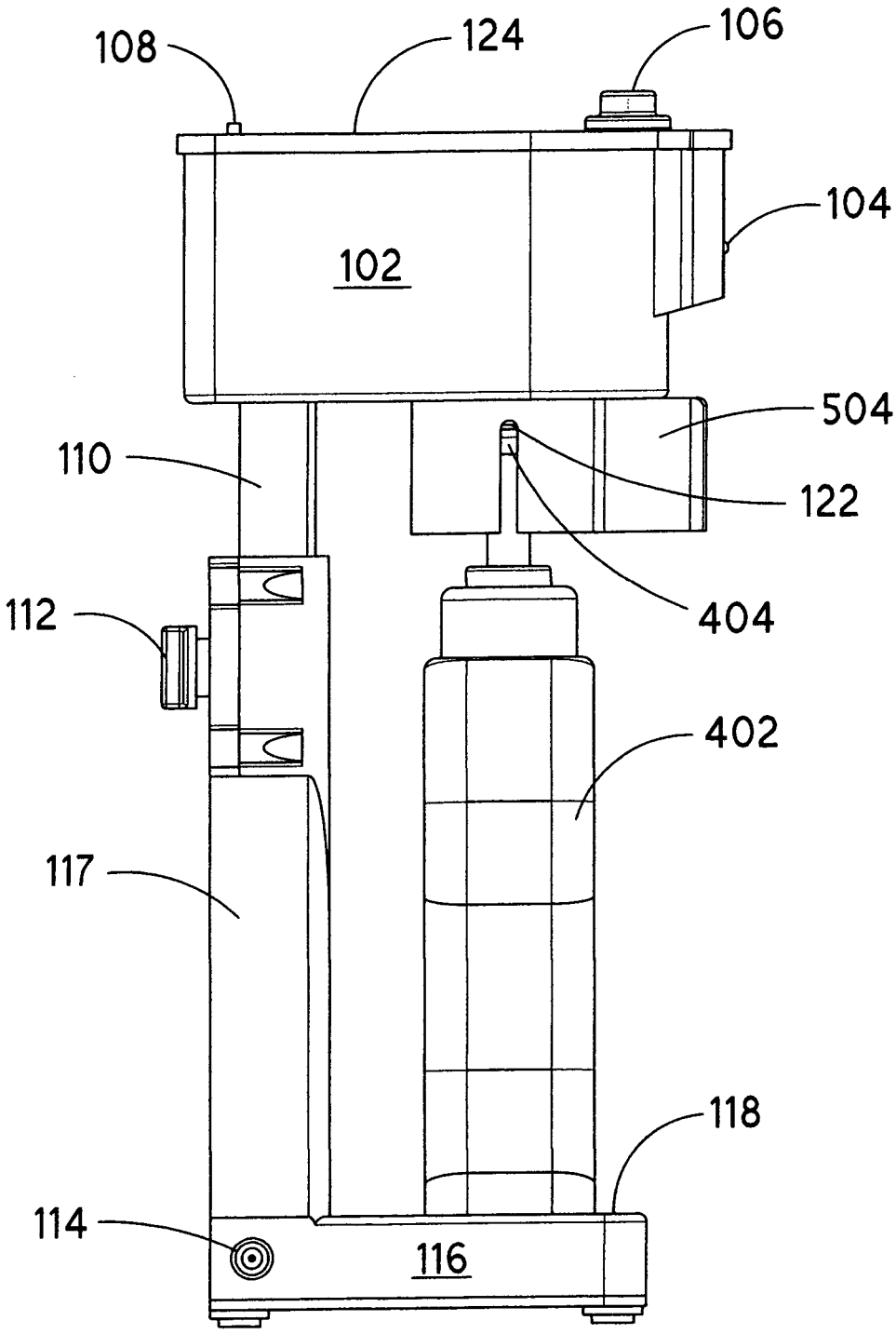
FIG. 5*a-b* are side plan views of the touch free dispenser of the present invention depicting the touch free dispenser adjusted for a first size of product container (FIG. 5*a*) and a second size product container (FIG. 5*b*).
Figure 5B:
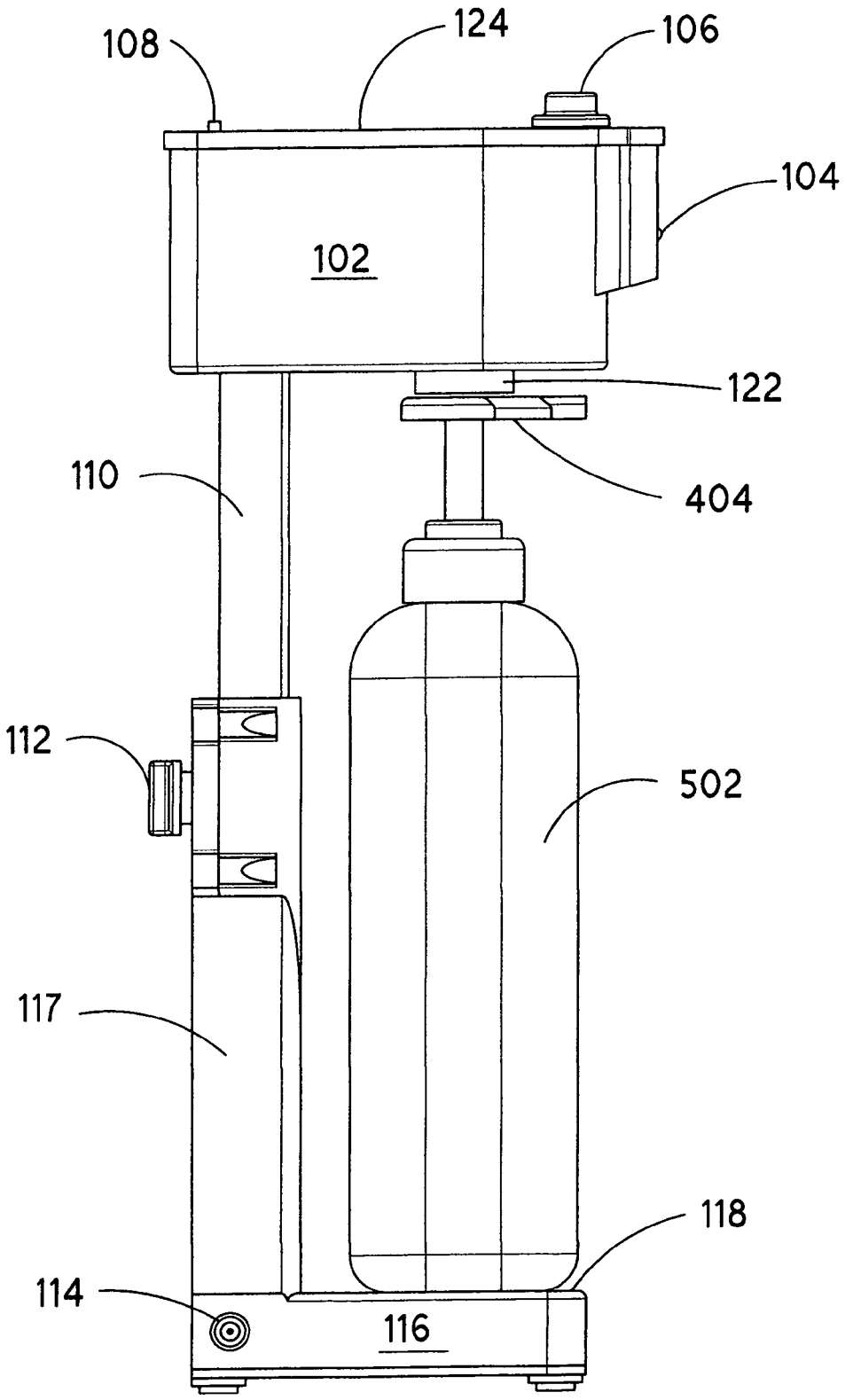

FIGS. 5*a* and 5*b* further illustrate the ability of Touch Free Dispenser 100 to accommodate varying sizes and shapes of product containers. FIG. 5*a* is a side plan view of Touch Free Dispenser 100 of the present invention depicting Touch Free Dispenser 100 adjusted for a smaller or shorter Product Container 402. Optional Shroud 504 is fixedly attached to the underside of Dispenser Head Assembly 102 and remains stationary as Dispenser Ram 406 moves down and up. Shroud 504 functions as an optional guard as well as helps to maintain the position of Product Container 402.

FIG. 5*b* is a side plan view of Touch Free Dispenser 100 adjusted to accept a larger or taller Alternate Container 502.

Figure 6:
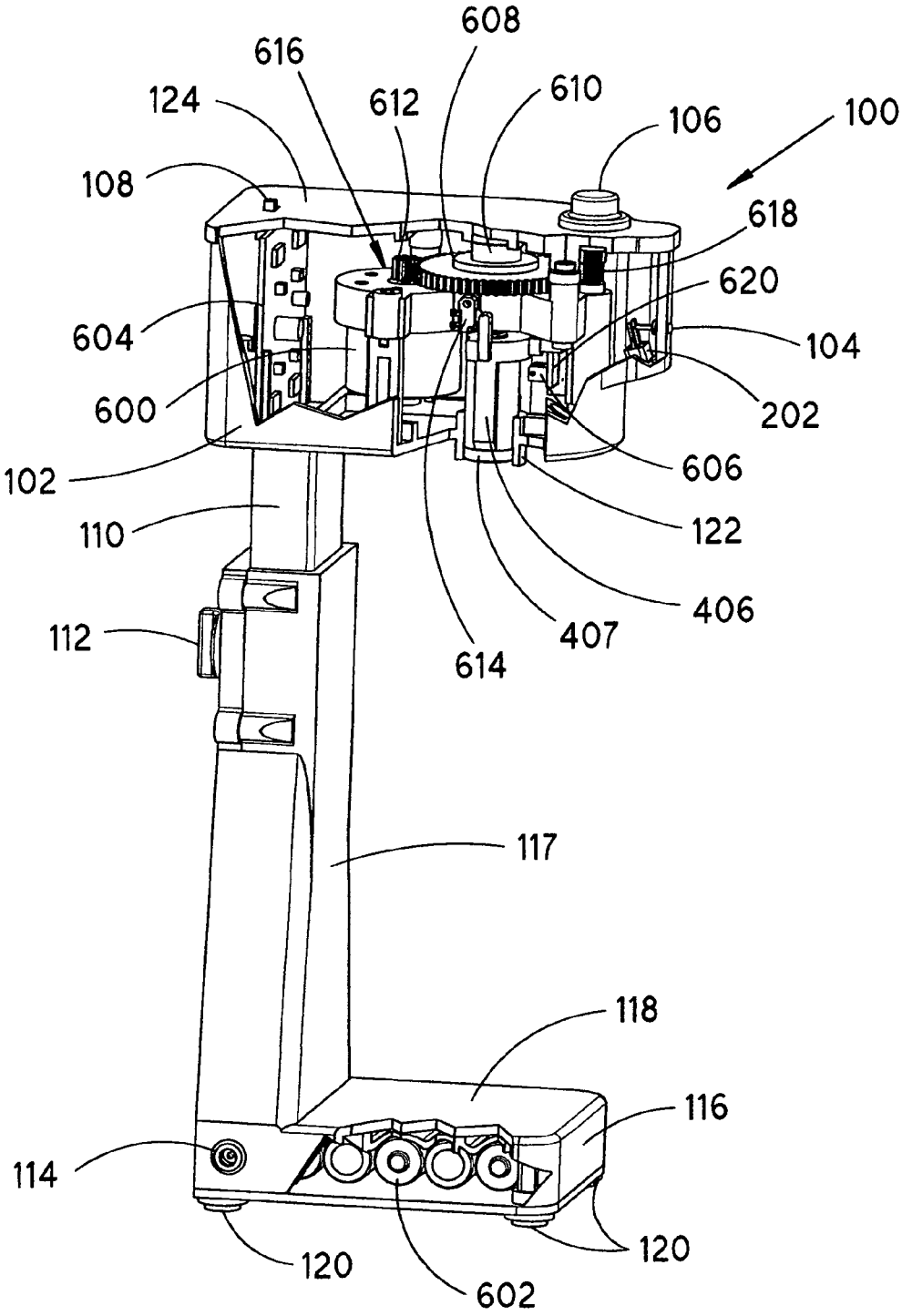
FIG. 6 is a perspective view of the touch free dispenser of the present invention with a cutaway view of the interior of the dispenser head assembly detailing the motor gear drive assembly as well as a cutaway of the dispenser base which houses the batteries and AC power adapter.

FIG. 6 is a perspective view of Touch Free Dispenser 100 of the present invention with a cutaway view of the interior of Dispenser Head Assembly 102 detailing Drive Assembly 616 which encompasses the components that together actuate Touch Free Dispenser 100 for dispensing product from Product Container 402. FIG. 6 also shows a cutaway view of Dispenser Base 116 which houses Batteries 602 and AC Adapter Plug 114.

When the user turns the On/Off Switch 108 to the on position, power is supplied to Control Board 604 of Drive Assembly 616 so that operation of Drive Motor 600 of Touch Free Dispenser 100 can be initiated by the user.

Control Board 604 is powered by Batteries 602 or transformed AC power. An example of the driver circuitry on Control Board 604 consists of a motor drive circuit using a PLC microcontroller and motor H-bridge driver circuitry. As one skilled in the art can appreciate, a variety of low voltage DC circuits that accepts inputs and triggers outputs is acceptable.

In the event of AC power, similar to other power cords, the AC to DC conversion is done within an AC transformer that plugs into a 110V wall sock then into AC Adapter Plug 114. One example of such an AC transformer is the Radio Shack® Enercell AC adapter, model #273-318. The selected transformer simply needs to supply Control Board 604 with the DC power prescribed by the selected control circuitry.

When a hand or object is placed in front of Touch Free Sensor 202 a signal is sent to Control Board 604. The signal initiates an output from Control Board 604 turning on Drive Motor 600. In FIG. 6, Drive Motor 600 is a low voltage brush DC motor. However, any small DC driven motor of a similar size can be used as well as a stepper motor or a similar sized AC motor. As Drive Motor 600 turns, it rotates Motor Drive Gear 612 affixed to the shaft of Drive Motor 600. Motor Drive Gear 612 of Drive Motor 600 drives Ram Drive Gear 608. As Ram Drive Gear 608 is rotated, it turns a lead screw (not shown) located within Dispenser Ram 406. This drives Dispenser Ram 406 downward compressing Pump Head 404. The load that is created when Dispenser Ram 406 compresses Pump Head 404 is transferred to Bearing 610 reducing the friction associated with compressing Dispenser Ram 406. Dispenser Ram 406 travels downward to a preset point that blocks the through beam (not shown) of Ram Height Adjustment Sensor 606. This initiates a signal to Control Board 604 which then initiates the output from Control Board 604 to turn off Drive Motor 600 thereby ending the dispensing of product from the product container. After a short delay Control Board 604 sends out an output to Drive Motor 600 reversing the direction of Drive Motor 600 thereby sending Dispenser Ram 406 upward. As soon as Dispense Ram 406 engages Ram Up Switch 614 it signals Control Board 604 to turn Drive Motor 600 off. As is common in dispensing containers, a spring (not shown) within Pump Head 404 spring returns Pump Head 404 to the up position in the absence of a pressure pressing it down—in this instant when Dispenser Ram 406 is in the retracted position.

It has been contemplated to use a belt drive, chain drive, or a friction drive in conjunction with the motor as an alternative to the gear drive shown in FIG. 6.

Throw Adjustment Knob 106 is attached to Throw Adjustment Lead Screw 618 which is threaded into Sensor Mount 620. Turning Throw Adjustment Knob 106 clockwise or counterclockwise raises or lowers, respectively, Ram Height Adjustment Sensor 606. As shown in FIG. 6, Ramp Up Switch 614 is a mechanical limit switch, however any triggering switch that will detect the position of Dispenser Ram 406 can be used.

The distance Pump Head 404 is compressed determines the amount of product that is dispensed from Product Container 402. To reduce or increase the amount of product dispensed from Product Container 402, the user turns Throw Adjustment Knob 106. When the user turns Throw Adjustment Knob 106, which is attached to the Throw Adjustment Lead Screw 618, it rotates Throw Adjustment Lead Screw 618 which is threaded into Sensor Mount 620. As Throw Adjustment Lead Screw 618 is turned, it raises or lowers the Ram Height Adjustment Sensor 606, depending on whether it is rotated clockwise or counter-clockwise. The higher Ram Height Adjustment Sensor 606 is, the less distance Pump Head 404 will be compressed thereby dispensing minimal product. Similarly, the lower Dispenser Height Adjustment Sensor 606 is, the further Pump Head 404 will be compressed thereby dispensing more product. In the preferred embodiment, Ram Height Adjustment Sensor 620 is a thru-beam sensor, however any triggering switch that will detect the position of Dispenser Ram 406 can be used, such as a mechanical limit switch similar to Up Switch 614 previously discussed.

Touch Free Dispenser 100 is powered by Batteries 602 or if the user desires an AC/DC Adapter (as previously discussed) can be plugged into AC Adapter Plug 114 bypassing the power provided by Batteries 602. With the AC/DC Adapter plugged into the wall and into AC Adapter Plug 114 of Dispenser Base 116, the resulting AC power provides the power to Control Board 604 of Drive Assembly 616 for the operation of Touch Free Dispense 100.

It has also been contemplated by the inventor to use rechargeable batteries with recharging provided by the AC/DC Adapter.

Figure 7:
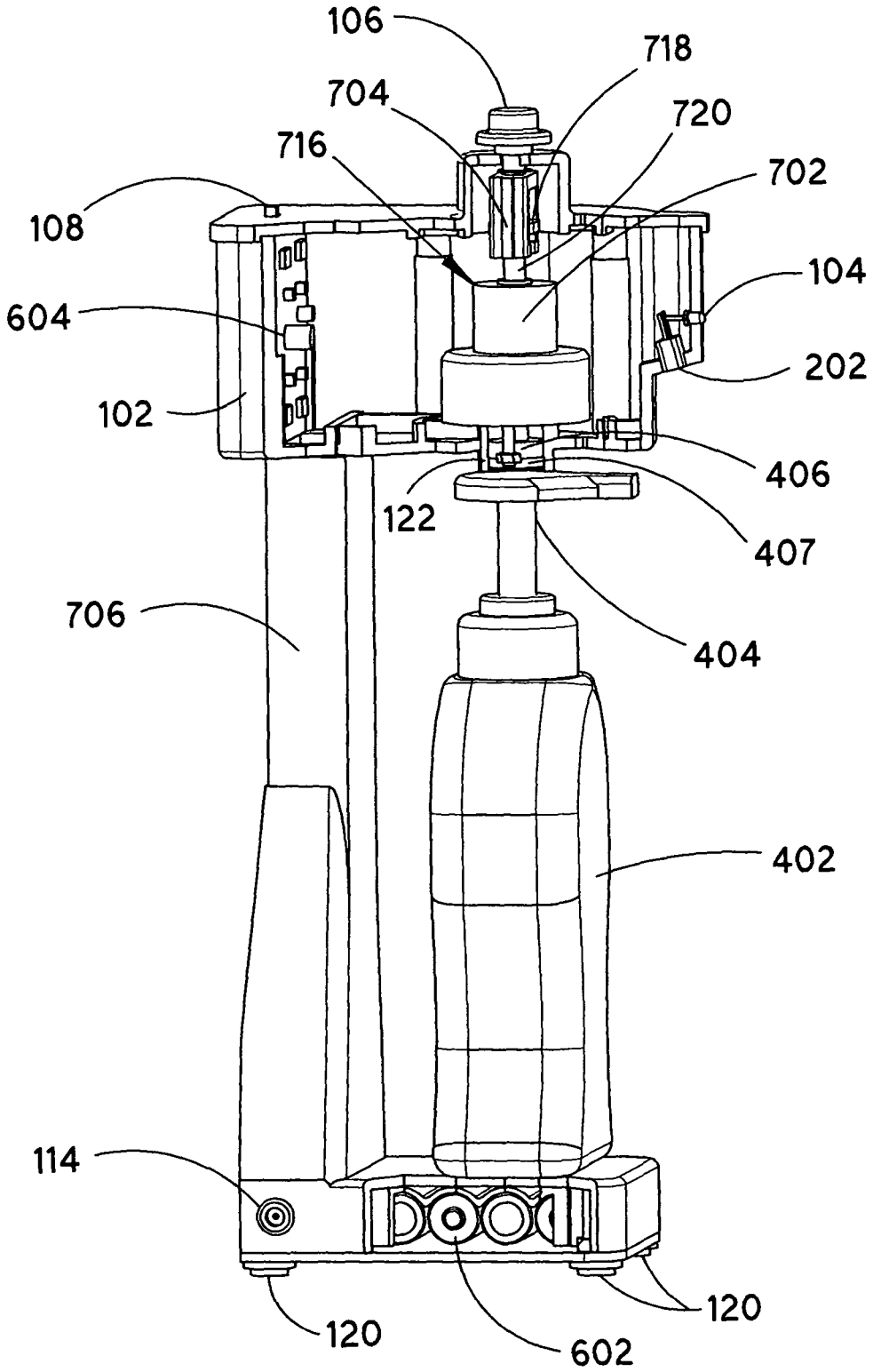
FIG. 7 is a perspective view of an alternate embodiment of the touch free dispenser of the present invention with a cutaway view of the interior of the dispenser head assembly detailing the solenoid drive assembly as well as a cutaway of the dispenser base which houses the batteries and AC power adapter.

FIG. 7 is a perspective view of an alternate embodiment of Touch Free Dispenser 100 of the present invention with a cutaway view of Alternate Drive Assembly 716 interior to Dispenser Head Assembly 102 detailing the use of a solenoid driven assembly. FIG. 7 also includes a cutaway of Dispenser Base 116 housing Batteries 602 and AC Adapter Plug 114.

In this alternate embodiment, the user turns On/Off Switch 108 to the on position and power is supplied to Control Board 604 of Alternate Drive Assembly 716 such that operation of Touch Free Dispenser 100 can be initiated.

FIG. 7 also accommodates a fixed size of Product Container 402 with Vertical Member 706 being a solid piece between Dispenser Head Assembly 102 and Dispenser Base 116. In this alternate embodiment, the amount of product dispensed is still variable by adjusting Throw Adjustment Knob 106.

Similar to the previously discussed operation, when a hand or object to receive product is placed in front of Touch Free Sensor 202, Touch Free Sensor 202 sends a signal to Control Board 604 of Alternate Drive Assembly 716. This signal initiates an output from Control Board 604 energizing Solenoid 702 which drives Dispenser Ram 406 downward through Ram Guide 112. When Solenoid 702 reaches a distance preset by Throw Adjustment Knob 106, Solenoid 702 returns to the up position after a short delay which varies depending on how far Dispenser Ram 406 was driven downward. It has been contemplated to include a down sensor similar to Ram Height Adjustment Sensor 606 to end the down cycle, but in this embodiment a constant down time cycle is set by Control Board 604. A spring (not shown) located within Pump Head 404 spring returns Pump Head 404 to the up position.

As discussed previously, the distance Pump Head 404 is compressed determines the amount of product dispensed from within Product Container 402. To reduce or increase the amount of product from Product Container 402, the user adjusts Throw Adjustment Knob 106. When the user rotates Throw Adjustment Knob 106 it rotates the lead screw (not shown) located within Adjustment Dispenser Stop 704 which raises or lowers Dispense Height stop 718 affixed to the end of the Top Solenoid Shaft 720. Turning Throw Adjustment Knob 106 clockwise or counter clockwise moves Adjustment Dispense Stop 704 and determines how far Dispenser Ram 406 compresses Pump Head 404.

Touch Free Dispenser 100 of FIG. 7 is also powered by Batteries 602. However, if the user desires, an AC/DC Adapter can be plugged into AC Adapter Plug 114 bypassing the power provided by Batteries 602. Touch Free Dispenser 100 is now powered by AC power from a wall socket. Due to the large amount of current required to run some solenoids, it may be preferred to configure Touch Free Dispenser 100 to run only on AC power from the wall socket. In some cases AC power may be the mode preferred by the user. Alternatively, the AC power can function as a backup if Batteries 602 fail.

Figure 8:
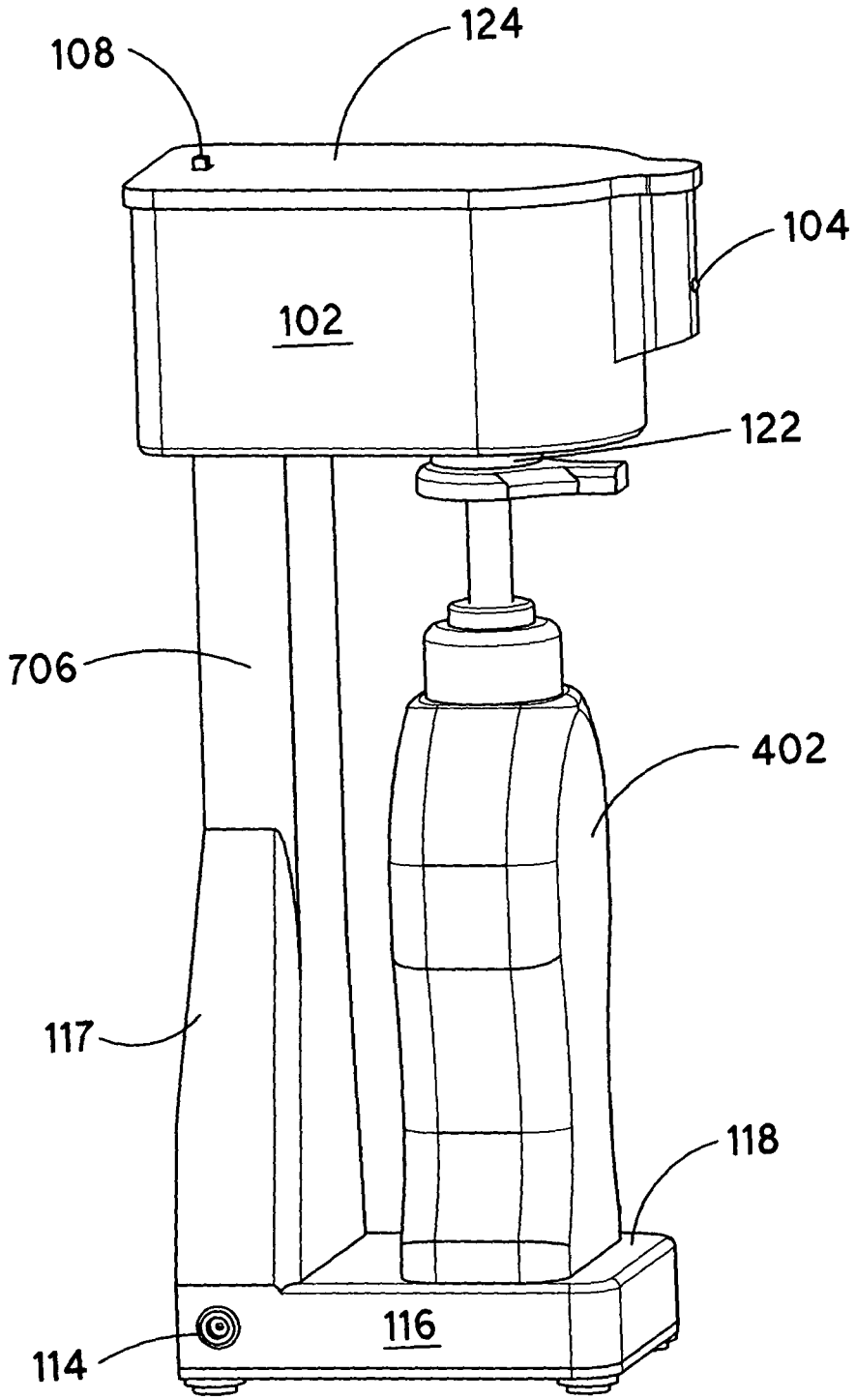
FIG. 8 is a perspective view of another alternate embodiment of the touch free dispenser of the present invention.

FIG. 8 is a perspective view of another alternate embodiment of Touch Free Dispenser 100 of the present invention. As shown in FIG. 8, Vertical Member 706 is a solid component and there is no Throw Adjustment Knob 106 for adjusting the amount of product that is dispensed. This alternative embodiment is intended for manufacturers choosing to permanently set the dispensing control and height of Touch Free Dispenser 100 to accommodate their particular line of products while providing a touch free system. For example, one manufacturer may make lotions, soaps, or other pumpable products in containers of similar heights and all can be used in the same touch free dispenser. An empty Product Container 402 is quickly replaced with a new Product Container 402 with no cleaning as the nozzle on Product Container 402 is used rather than pumping the product through a pumping system integral to the dispenser as is typical with the touch free dispensers on the market today.

Wherein the terms and expressions which have been employed in the foregoing specification are used therein as terms of description and not of limitation, there is no intention, in the use of such terms and expressions, of excluding equivalents of the features shown and described or portions thereof, it being recognized that the scope of the invention is defined and limited only by the claims which follow.

I claim:

1. A multi-product touch free dispenser for dispensing a quantity of a product from a product container having a pump head in fluid communication with the product, comprising:

a dispenser head assembly housing an electrically powered drive assembly;

a touch free sensor having a view range and disposed on a front portion of said dispenser head assembly and in electrical communication with said drive assembly;

a dispenser ram extending downward from said drive assembly and extending through a bottom surface of said dispenser head assembly;

a dispenser base having a base top surface;

a hallow lower vertical member extending perpendicularly upward from and fixedly attached to said dispenser base;

a unit height slide rail fixedly attach to and extending perpendicularly from said bottom surface of said dispenser head assembly and slideably attached within said lower vertical member; and a unit height adjustment knob screwably attached through an outer surface of said lower vertical member having a first position allowing said unit height slide rail to slide freely within said lower vertical member and a second position contacting said unit height slide rail restricting movement of said unit height slide rail;

wherein, with the product container placed on said base top surface and said unit height adjustment knob in said first position, said dispenser head assembly is raised or lowered such that the pump head is in contact with said dispenser ram, said unit height adjustment knob is turned to said second position thereby eliminating movement between said lower vertical member and said unit height slide rail, a user places an object within said view range of said touch free sensor sending a signal to said drive assembly thereby extending said dispenser ram depressing the pump head, and dispensing the quantity of the product onto said object, whereby the product container can be of a plurality of sizes and shapes and contain a variety of the product.

2. The multi-product touch free dispenser of claim 1, wherein said dispenser head assembly further comprising:

a throw adjustment knob disposed on a head assembly top surface and in electrical communication with said drive assembly, wherein said user turns said throw adjustment knob a first direction to increase a distance said dispenser ram extends and a second direction to decrease said distance said dispenser ram extends thereby adjusting the quantity of the product dispensed on said object.

3. The multi-product touch free dispenser of claim 1, wherein said drive assembly is powered by a series of batteries housed within said dispenser base.

4. The multi-product touch free dispenser of claim 1, wherein said drive assembly is powered by an AC source.

5. The multi-product touch free dispenser of claim 1, wherein said dispenser ram is extended by actuation of a solenoid valve within said drive assembly.

6. The multi-product touch free dispenser of claim 1, wherein said dispenser ram is extended by powering a drive motor within said drive assembly.

7. The multi-product touch free dispenser of claim 1, further comprising a shroud fixedly attached to said front portion of said dispenser head assembly below said touch free sensor and extending downward shielding the pump head.

8. The multi-product touch free dispenser of claim 1, further comprising a base non slip pad disposed on said base top surface for stabilizing the product container.

9. The multi-product touch free dispenser of claim 1, further comprising a ram pad disposed on said dispenser ram for stabilizing contact between said dispenser ram and the pump head.

10. A multi-product touch free dispenser for dispensing a quantity of a product from a product container having a pump head in fluid communication with the product, comprising:

a dispenser head assembly housing an electrically powered drive assembly;

a touch free sensor having a view range and disposed on a front portion of said dispenser head assembly and in electrical communication with said drive assembly;

a dispenser ram extending downward from said drive assembly and extending through a bottom surface of said dispenser head assembly;

a throw adjustment knob disposed on a head assembly top surface and in electrical communication with said drive assembly, said throw adjustment knob rotates between a first position and a second position varying a distance said dispenser ram extends and compresses the pump head;

a dispenser base having a base top surface; and a vertical member extending perpendicularly upward from and fixedly attached to said dispenser base at a first end and extending perpendicularly downward and fixedly attached to said bottom surface of said dispenser head assembly at a second end;

wherein, with the product container placed on said base top surface, a user rotates said throw adjustment knob between said first position and said second position to adjust said distance said dispenser ram extends thereby adjusting the quantity of the product to be dispensed, said user places an object within said view range of said touch free sensor sending a signal to said drive assembly thereby extending said dispenser ram and depressing the pump head thereby dispensing the quantity of the product onto said object, whereby the product container can be of a plurality of sizes and shapes and contain a variety of the product.

11. The multi-product touch free dispenser of claim 10, wherein said drive assembly is powered by a series of batteries housed within said dispenser base.

12. The multi-product touch free dispenser of claim 10, wherein said drive assembly is powered by an AC source.

13. The multi-product touch free dispenser of claim 10, wherein said dispenser ram is extended by actuation of a solenoid valve within said drive assembly.

14. The multi-product touch free dispenser of claim 10, wherein said dispenser ram is extended by powering a drive motor within said drive assembly.

15. The multi-product touch free dispenser of claim 10, further comprising a base non slip pad disposed on said base top surface for stabilizing the product container.

16. The multi-product touch free dispenser of claim 10, further comprising a ram pad disposed on said dispenser ram for stabilizing contact with the pump head.

17. A multi-product touch free dispenser for dispensing a quantity of a product from a product container having a pump head in fluid communication with the product, comprising:

a dispenser head assembly housing an electrically powered drive assembly;

a touch free sensor having a view range and disposed on a front portion of said dispenser head assembly and in electrical communication with said drive assembly;

a dispenser ram extending downward from said drive assembly and extending through a bottom surface of said dispenser head assembly;

a throw adjustment knob rotatably attached through a head assembly top surface and in electrical communication with said drive assembly, said throw adjustment knob adjustable between a first direction to increase a distance said dispenser ram extends and a second direction to decrease said distance said dispenser ram extends;

a dispenser base having a base top surface;

a hallow lower vertical member extending perpendicularly upward from and fixedly attached to said dispenser base;

a unit height slide rail fixedly attached to and extending perpendicularly downward from said bottom surface of said dispenser head assembly and slideably attached within said lower vertical member; and a unit height adjustment knob screwably attached through an outer surface of said lower vertical member having a first position allowing said unit height slide rail to slide freely within said dispenser base lower vertical member and a second position firmly contacting said unit height slide rail restricting movement of said unit height slide rail;

wherein, with the product container placed on said base top surface and said unit height adjustment knob in said first position, a user adjusts said dispenser head assembly such that the pump head is in contact with said dispenser ram, said user turns said unit height adjustment knob to said second position, said user rotates said throw adjustment knob thereby setting said distance said dispenser ram extends, said user places an object within said view range of said touch free sensor sending a signal to said drive assembly thereby extending said dispenser ram depressing the pump head, and dispensing the quantity of the product onto said object, whereby the product container can be of a plurality of sizes and shapes and contain a variety of the product.

18. The multi-product touch free dispenser of claim 17, further comprising a base non slip pad disposed on said base top surface for stabilizing the product container.

19. The multi-product touch free dispenser of claim 17, further comprising a ram pad disposed on said dispenser ram for stabilizing contact with the pump head.

20. A multi-product touch free dispenser for dispensing a quantity of a product from a product container having a pump head in fluid communication with the product, comprising:

a dispenser head assembly housing an electrically powered drive assembly;

a touch free sensor having a view range and disposed on a front portion of said dispenser head assembly and in electrical communication with said drive assembly;

a dispenser ram extending downward from said drive assembly and extending through a bottom surface of said dispenser head assembly;

a dispenser base having a base top surface; and a hallow vertical member extending perpendicularly upward from and fixedly attached to said top surface of said dispenser base on a first end and extending downward and fixedly attached to a bottom surface of said dispenser head assembly on a second end;

wherein, with the product container placed on said top surface of said dispenser base and the pump head is proximate said dispenser ram, a user places an object within said view range of said touch free sensor sending a signal to said drive assembly thereby extending said dispenser ram depressing the pump head, and dispensing the quantity of the product onto said object, whereby the product container can be of a plurality of sizes and shapes and contain a variety of the product.

* * * * *